US011964802B2

(12) United States Patent
Suehiro

(10) Patent No.: US 11,964,802 B2
(45) Date of Patent: Apr. 23, 2024

(54) PACKAGE

(71) Applicant: Shinya Suehiro, Kanagawa (JP)

(72) Inventor: Shinya Suehiro, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 288 days.

(21) Appl. No.: 17/351,487

(22) Filed: Jun. 18, 2021

(65) Prior Publication Data

US 2021/0394950 A1 Dec. 23, 2021

(30) Foreign Application Priority Data

Jun. 22, 2020 (JP) ..... 2020-107101
Mar. 29, 2021 (JP) ..... 2021-055033

(51) Int. Cl.
*B65D 5/468* (2006.01)
*B65D 5/46* (2006.01)

(52) U.S. Cl.
CPC ..... *B65D 5/4608* (2013.01); *B65D 5/46088* (2013.01)

(58) Field of Classification Search
CPC ..... B65D 5/4608; B65D 5/46088; B65D 5/46072; B65D 5/0236; B65D 5/542; B65D 5/703; B65D 2525/281; B65D 5/5415; B65D 5/544; B31B 50/20; B31B 50/25
USPC ..... 229/117.13, 117.14, 117.15, 237, 198.2
See application file for complete search history.

(56) References Cited

U.S. PATENT DOCUMENTS 2,661,142 A * 12/1953 Hendrickson, Jr. ..... B65D 5/46072 229/117.14
4,140,267 A * 2/1979 Scott ..... B65D 5/46088 229/199
7,143,931 B2 * 12/2006 Johnson ..... B65D 5/0245 229/120.16
9,248,933 B2 * 2/2016 Spivey, Sr. ..... B65D 5/4204
9,789,994 B2 * 10/2017 Takeuchi ..... B65D 5/4266
10,683,130 B2 * 6/2020 Takeuchi ..... B65D 5/6694
10,850,447 B2 * 12/2020 Gasso ..... B65D 5/2052

FOREIGN PATENT DOCUMENTS

CH 579481 A5 9/1976
CH 589538 A5 7/1977
JP S4717927 U 10/1972
(Continued)

OTHER PUBLICATIONS

Extended European Search Report dated Nov. 30, 2021 issued in corresponding European Appln. No. 21180334.1.

*Primary Examiner* — Christopher R Demeree
(74) *Attorney, Agent, or Firm* — Harness, Dickey & Pierce, P.L.C.

(57) ABSTRACT

A package includes a structure and a handle structure portion. The structure constitutes a housing space to house a packaged object. The handle structure portion is disposed in the structure, formed by a perforated line, and lifted from the structure. The perforated line includes a cut portion, a connecting portion, and a notched cut line. The notched cut line is provided with respect to a central reference line that is an axis of symmetry of the handle structure portion. The notched cut line includes a base portion and a leading end. The notched cut line is included within a range closer to the boundary point than a center line of the connecting portion parallel to the lifting direction of the handle structure portion.

20 Claims, 10 Drawing Sheets

(56) References Cited

FOREIGN PATENT DOCUMENTS

| | | |
|---|---|---|
| JP | 2-015414 | 1/1990 |
| JP | 2-102329 | 8/1990 |
| JP | 2003-095249 | 4/2003 |

* cited by examiner

PACKAGE

CROSS-REFERENCE TO RELATED APPLICATION

This patent application is based on and claims priority pursuant to 35 U.S.C. § 119(a) to Japanese Patent Application No. 2020-107101, filed on Jun. 22, 2020, and 2021-055033, filed on Mar. 29, 2021 in the Japan Patent Office, the entire disclosure of which is hereby incorporated by reference herein.

BACKGROUND

Technical Field

Embodiments of the present disclosure relate to a package.

Description of the Related Art

Among the specifications for packaging products such as precision machines, in a case in which two conditions described below are satisfied, as illustrated in FIG. 20, a "multiple packaging specification" is adopted in which a product to be packaged is placed in an inner box 2 such as a corrugated cardboard box to fix the product, and the product is further placed in an outer box 3 and packaged to ensure product protection quality.

Condition 1

As illustrated in FIG. 21, the rigidity of the product needs to be supported by a rigidity supporting member 5 and an inner box 2 to prevent the structural deformation of the product.

Condition 2

As illustrated in FIG. 22, when the outer shape of a product 1 has protruding portions such as a pin or a gear, due to the outer shape or properties of a packaging material 4 used for fixing and cushioning, the outer shape of the product 1 and the packaging material 4 come into point-to-surface local contact with each other.

There is known a packaging case in which a perforated line formed by a semicircular or U-shaped perforation or the like is provided in a single or double manner as a non-cut portion on an upper surface of a box body made of cardboard, corrugated cardboard, or the like. In the packaging case, a handle portion corresponding to the handle is formed by cutting off the perforated lines.

SUMMARY

In an aspect of the present disclosure, a package includes a structure and a handle structure portion. The structure constitutes a housing space to house a packaged object. The handle structure portion is disposed in the box structure and formed by a perforated line and lifted from the structure. The perforated line includes a cut portion, a connecting portion, and a plurality of notched cut lines. The plurality of notched cut lines starts from a boundary point between a cutting termination end of the cut portion and a cutting start end of the connecting portion. The plurality of notched cut lines is provided symmetrically with respect to a central reference line that is an axis of symmetry of the handle structure portion. Each of the plurality of notched cut lines includes a base portion and a leading end portion. The base portion extends from the boundary point in parallel to or at an acute angle with respect to a lifting direction of the handle structure portion. The leading end portion is turned from the base portion toward a distal end portion of the connecting portion or a vicinity of the distal end portion of the connecting portion. Each of the plurality of notched cut lines is included within a range closer to the boundary point than a center line of the connecting portion parallel to the lifting direction of the handle structure portion.

In another aspect of the present disclosure, a package includes a structure and a handle structure portion. The structure constitutes a housing space to house a packaged object. The handle structure portion is disposed in the box structure and formed by a perforated line and lifted from the structure. The perforated line includes a cut portion, a connecting portion, and a plurality of notched cut lines. The plurality of notched cut lines starts from a boundary point between a cutting termination end of the cut portion and a cutting start end of the connecting portion. The plurality of notched cut lines is provided symmetrically with respect to a central reference line that is an axis of symmetry of the handle structure portion. Each of the plurality of notched cut lines includes a base portion and a leading end portion. The base portion extends from the boundary point in parallel to or at an acute angle with respect to a lifting direction of the handle structure portion. The leading end portion is turned from the base portion toward a distal end portion of the connecting portion or a vicinity of the distal end portion of the connecting portion. Each of the plurality of notched cut lines is included within a range closer to the boundary point than a center line of the connecting portion parallel to the lifting direction of the handle structure portion.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
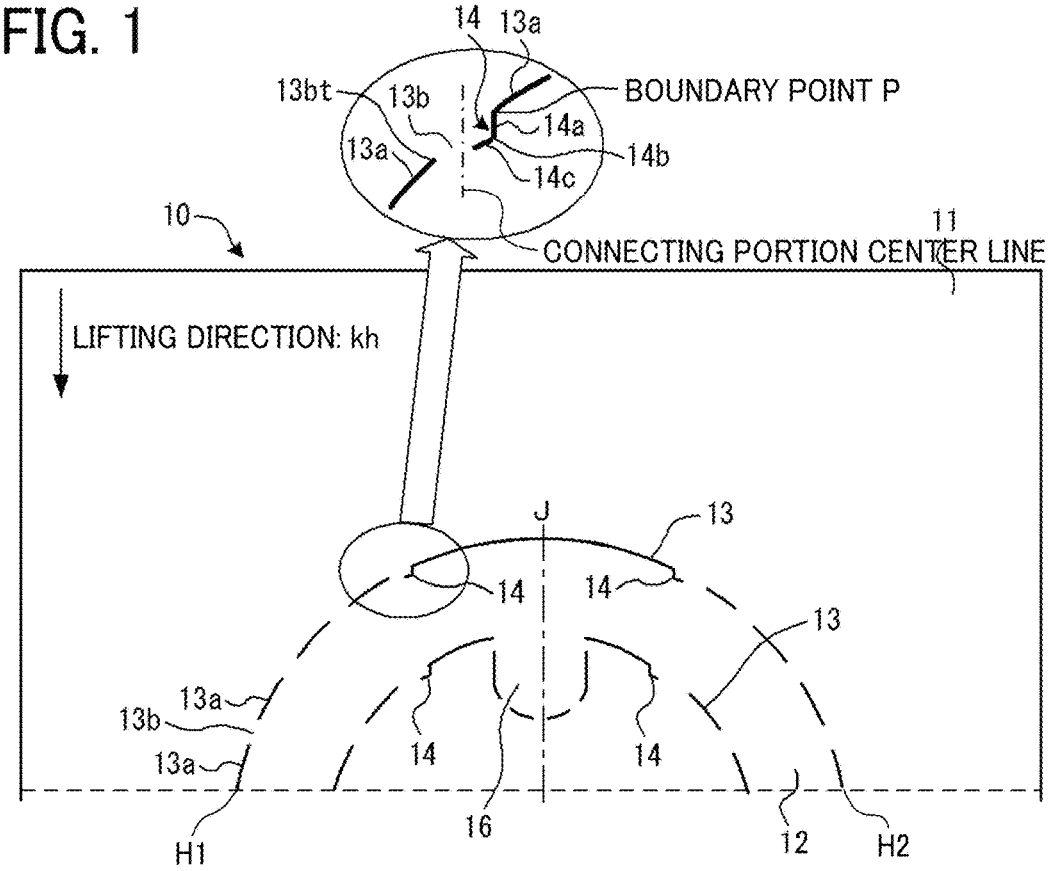
FIG. 1 is a schematic plan view of an upper surface of an inner box of a package including perforated lines with an enlarged view of a portion of the perforated line according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 23:
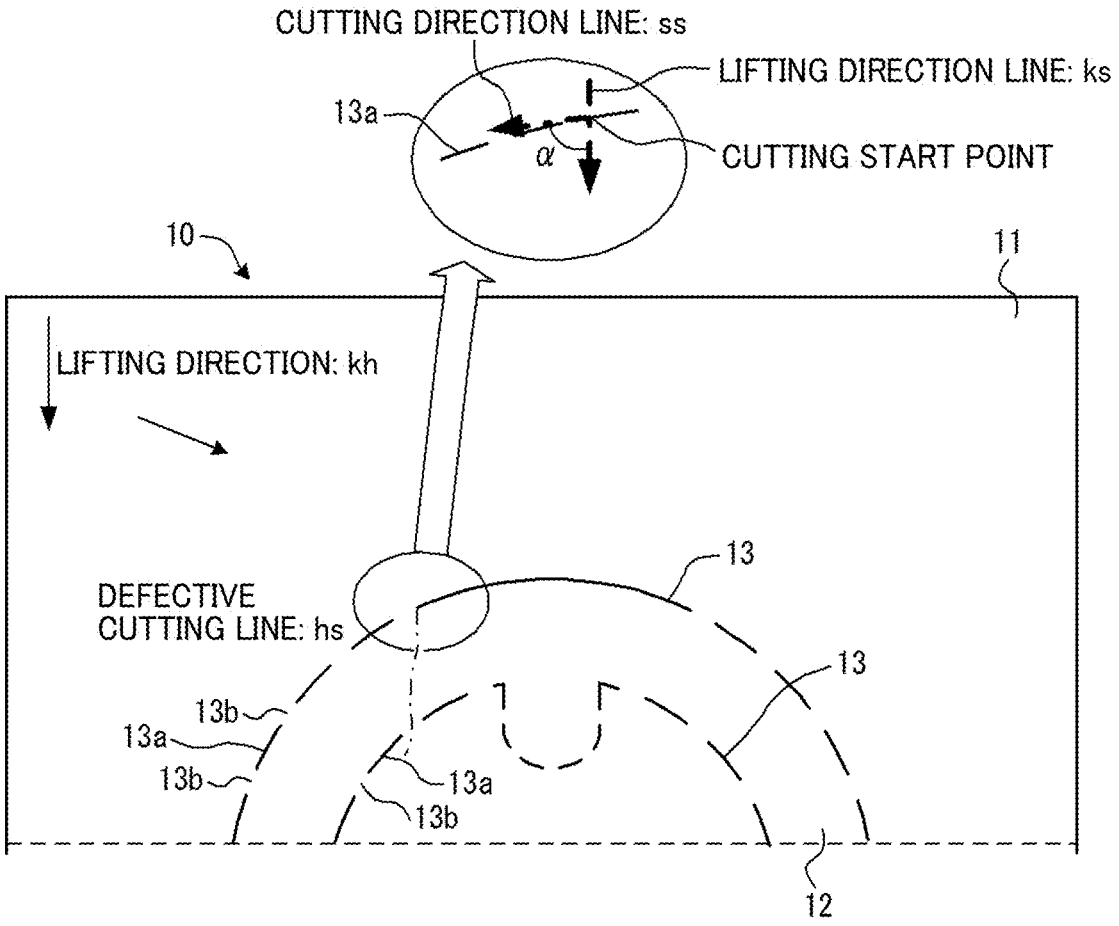
FIG. 23 is a schematic plan view of a part of an inner box of a package including perforated lines with an enlarged view of a portion of the perforated line illustrating a disadvantage of a conventional packaging technology.

First, a description is given of a point that a large force is required to cut and lift a handle structure portion (handle portion) as a conventional disadvantage with reference to FIG. 23.

In FIG. 23, on an upper surface 11 of an inner box 10 as a packaging body, perforated lines 13 such as stitch perforations for forming a handle portion 12 (handle structure portion) by cutting and lifting the handle portion 12 is doubly provided in this example. Each of the perforated lines 13 includes cut portions 13*a* and connecting portions 13*b*. In FIG. 23, a defective cut line hs extends from an end of one of the cut portions 13*a* of the outer perforated line 13. A large force is applied to the defective cut line hs during the cutting and lifting operation of the handle portion 12. Thus, the defective cut line hs is forcibly cut. Therefore, the original function of the handle portion 12 is impaired.

The vicinity of a starting point of the defective cut line hs is enlarged and illustrated in FIG. 23. In the enlarged portion, a dashed-line arrow extending straight downward is a lifting direction line ks indicating a lifting direction when the handle portion 12 as the separated and formed portion is cut and lifted. Another dashed-line arrow extending in a tangent direction of the cut portion 13*a* is a cutting direction line ss indicating a direction of the cut line, that is, the direction in which cutting is to be correctly performed. An angle formed by the cutting direction line ss and the lifting direction line ks is indicated as "$\alpha$".

When the cutting direction line ss and the lifting direction line ks are parallel to each other or the angle $\alpha$ is small, the force required for cutting and lifting the handle portion 12 is small. In addition, defective cutting does not occur and normal cutting is performed. Thus, the handle portion 12 (handle structure portion) is cut and lifted to be appropriately formed.

On the other hand, when the cutting direction line ss and the lifting direction line ks are not parallel to each other and the angle $\alpha$ is equal to or greater than 45 degree, a stress moving toward the lifting direction line (arrow ks) and a stress moving toward the cutting direction of the cut line (the cutting direction line ss) are applied and concentrated to the cutting start point, which is a boundary point between the connecting portion 13*b* and the adjacent cut portion 13*a*. Accordingly, misalignment is generated in a direction in which cutting is likely to occur and cutting is unlikely to progress due to the stress concentration. Thus, a large force is required to cut and lift the handle portion 12 while cutting.

On the other hand, in embodiments of the present disclosure, perforated cut lines parallel to or having an acute angle (the angle α is zero or an acute angle) with respect to the lifting direction line ks of the handle structure portion (handle portion) are provided in advance with the boundary point between the connecting portion and the adjacent cut portion as a starting point, while the positions and the number of the connecting portions of the perforated lines for separating and forming the handle structure portion (handle portion) are secured in the same manner as in the related art.

Hereinafter, a detailed description is given of embodiments of the present disclosure with reference to drawings.

FIG. 1 is a schematic plan view of a part of an inner box of a package including perforated lines and an enlarged view of a portion of a perforated line according to an embodiment of the present disclosure. Note that in the following description, the same or equivalent parts as those described with reference to FIG. 23 are described by the same reference numerals.

In FIG. 1, on the upper surface 11 of the inner box 10 that is a packaging body, the perforated lines 13 such as perforations for cutting and lifting the handle portion 12 (handle structure portion) that is a separation-forming structure are doubly provided in this example. Each of the perforated lines 13 includes cut portions 13*a* and connecting portions 13*b*, and the cut portions 13*a* and the connecting portions 13*b* are alternately arranged on each of the perforated lines 13.

In the present example, two (double) perforated lines 13 are provided so that the shape of the handle portion 12 is substantially semicircular when the handle portion 12 is cut and lifted. The double perforated lines 13 are provided so as to be substantially symmetrical with respect to a center reference line J. That is, the central reference line J is an axis of symmetry of the handle portion 12. In FIG. 1, the center reference line J passes through an intermediate point between an outer end H1 and an outer end H2 of the handle portion 12 on a boundary line (dotted line in FIG. 1) between the upper surface 11 and an adjacent surface 18.

The vicinity of one connecting portion (vicinity of a predetermined connecting portion) of the perforated line 13 is illustrated in an enlarged manner in FIG. 1. As illustrated in the enlarged portion in FIG. 1, a notched cut line 14 extending in a direction parallel to a lifting direction (a direction for lifting the handle portion 12) indicated by an arrow kh in FIG. 1 is provided with a boundary point P as a starting point. The boundary point P is a boundary point between a cutting termination end of the cut portion 13*a* and a cutting start end of the connecting portion 13*b*.

That is, the notched cut line 14 is provided with the boundary point P between the predetermined cut portion 13*a* and the connecting portion 13*b* as a starting point. The notched cut line 14 includes a base portion 14*a* extending from the boundary point P in parallel with or at an acute angle to the lifting direction of the handle portion 12 as a handle structure portion, and a leading end 14*c* turned from the base portion 14*a* and directed to a distal end 13*bt* or the vicinity of the distal end 13*bt* of the connecting portion 13*b*. The notched cut lines 14 are provided so as to be positioned within a range between the boundary point P and the center of the connecting portion 13*b*.

In FIG. 1, the outer notched cut lines 14 and the inner notched cut lines 14 are formed to be connected with the cut portions 13*a* of the perforated lines 13 closest to the central reference line J, and are formed at four positions in total on both sides of the central reference line J. As illustrated in FIG. 1, the outer notched cut lines 14 and the inner notched cut lines 14 are formed in pairs.

FIG. 1 illustrates an example in which the base portion 14*a* is parallel to the lifting direction kh. However, the notched cut line 14 may have an angular relationship in which the base portion 14*a* forms an acute angle with respect to the lifting direction kh (lifting direction line ks) as described above.

Figure 2:
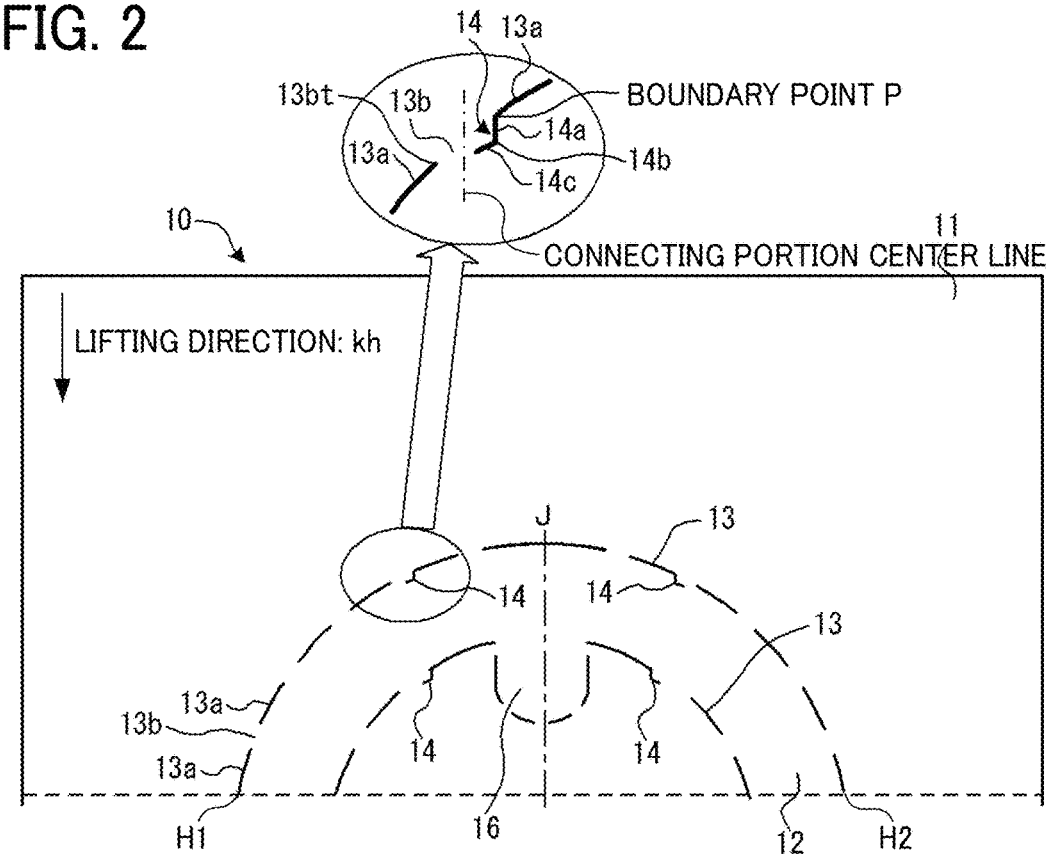
FIG. 2 is a schematic plan view of an upper surface of an inner box of a package including perforated lines according to another embodiment of the present disclosure.

FIG. 2 is a schematic plan view of the upper surface 11 of the inner box 10 of a package including perforated lines according to another embodiment of the present disclosure.

In FIG. 2, outer notched cut lines 14 are formed at two positions in cut portions 13*a* of a perforated line 13 positioned second from the central reference line J, whereas inner notched cut lines 14 are formed at two positions in cut portions 13*a* of a perforated line 13 closest to the central reference line J. Other portions in FIG. 2 are equivalent to portions in FIG. 1. Thus, the description thereof will be omitted.

Figure 3:
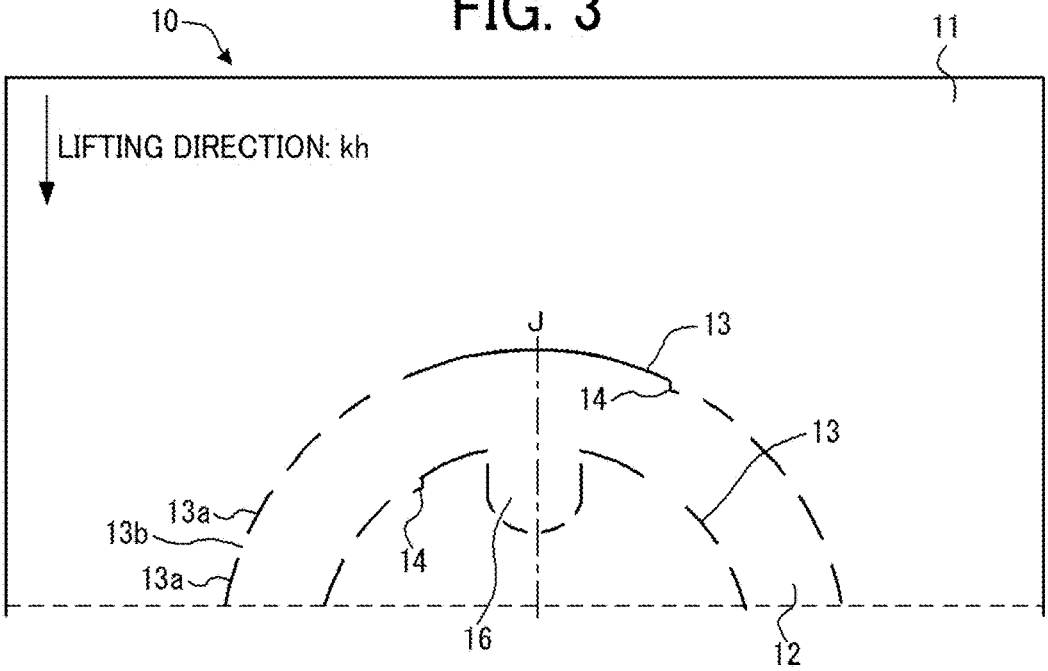
FIG. 3 is a schematic plan view of an upper surface of an inner box of a package including perforated lines according to still another embodiment of the present disclosure.

FIG. 3 is a schematic plan view of an upper surface 11 of an inner box 10 of a package including perforated lines according to still another embodiment of the present disclosure.

In FIG. 3, an outer notched cut line 14 is formed to be connected with one cut portion 13*a* of a perforated line 13 closest to the central reference line J at one position. An inner notched cut line 14 is formed to be connected with a cut portion 13*a* of a perforated line 13 closest to the central reference line J at one position. As illustrated in FIG. 3, the positions of the notched cut lines 14 may not be symmetrical with respect to the central reference line J, and the outer notched cut line 14 and the inner notched cut line 14 may not be formed as a pair. Other portions in FIG. 3 are equivalent to portions in FIG. 1. Thus, the description thereof will be omitted.

Figure 4:
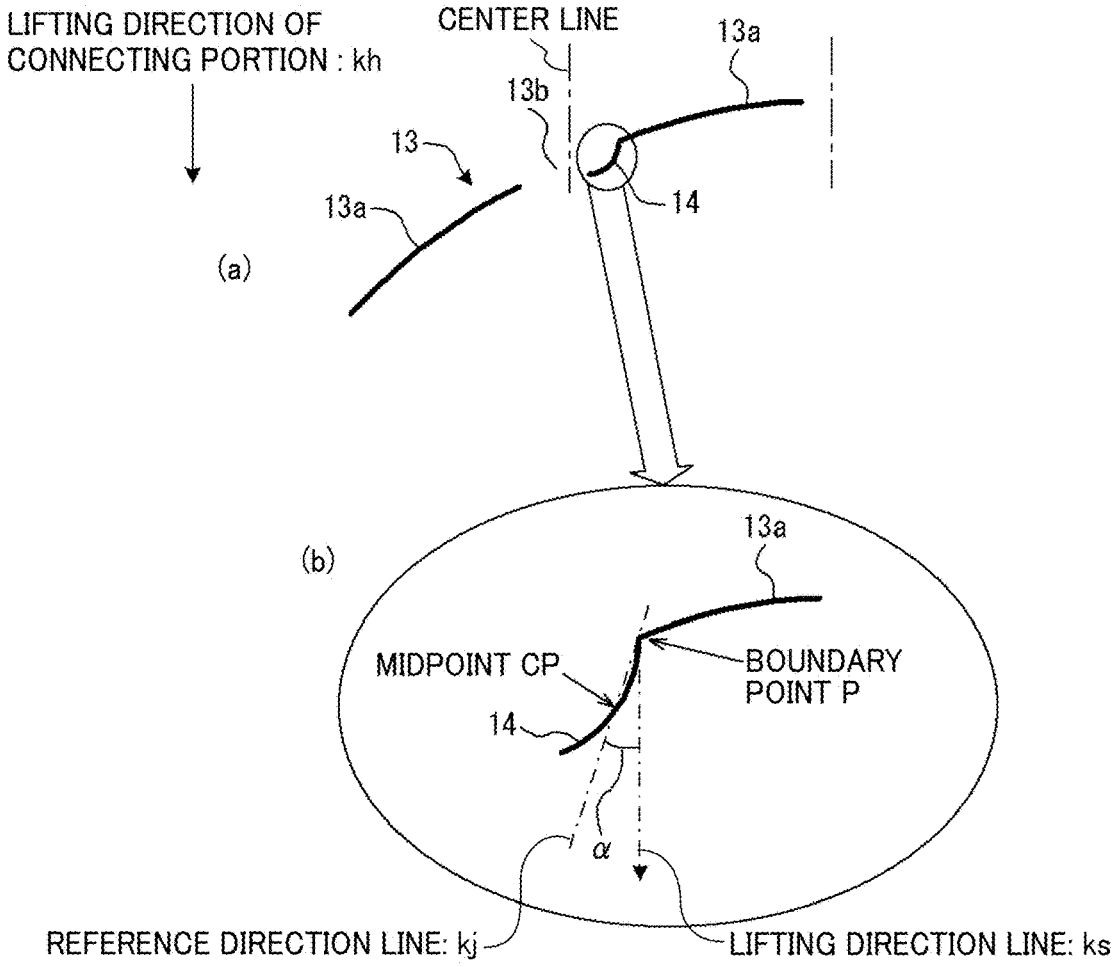
FIG. 4 is a schematic view of a notched cut line as a curved line provided on a package according to an embodiment of the present disclosure.

Note that the notched cut lines 14 illustrated in FIGS. 1, 2, and 3 are notched straight lines provided as examples. However, the notched cut lines 14 may be curved lines. FIG. 4 illustrates an example of a notched cut line 14 as a curved line. Part (a) of FIG. 4 is a schematic view of a perforated line 13 having the notched cut line 14, and part (b) of FIG. 4 is an enlarged view of a portion surrounded by a circle in part (a) of FIG. 4.

In part (b) of FIG. 4, the notched cut line 14 includes a curve in which an angle α formed by a reference direction line kj, which connects a middle point CP of the notched cut line 14 and the boundary point P that is a start point of the notched cut line 14, and a lifting direction line ks is an acute angle. When the angle α is 0 degrees, the reference direction line kj coincides with the lifting direction line ks passing through the boundary point P, and the reference direction line kj is a curve parallel to the handle lifting direction kh.

Providing the notched cut lines 14 as illustrated in FIGS. 1, 2, 3, and 4 allows to lift the handle portion 12 (handle structure portion), which is the separation-forming structure, with little resistance force in the initial stage of lifting the handle portion 12. For this reason, the handle portion 12 as the separation-forming structure is separated from the base structure (the structure of the inner box 10) at an early stage of lifting the handle portion 12. Thus, the resistance due to the interference of the base structure is removed, and a divided force in a direction of the working force of the cut-and-lifting operation of the handle portion 12 is partially parallel to the lifting direction. Accordingly, the cutting of the connecting portion 13*b* can be facilitated and the cut-and-lifting operation of the handle portion 12 can be performed in a more labor-saving manner.

Figure 5:
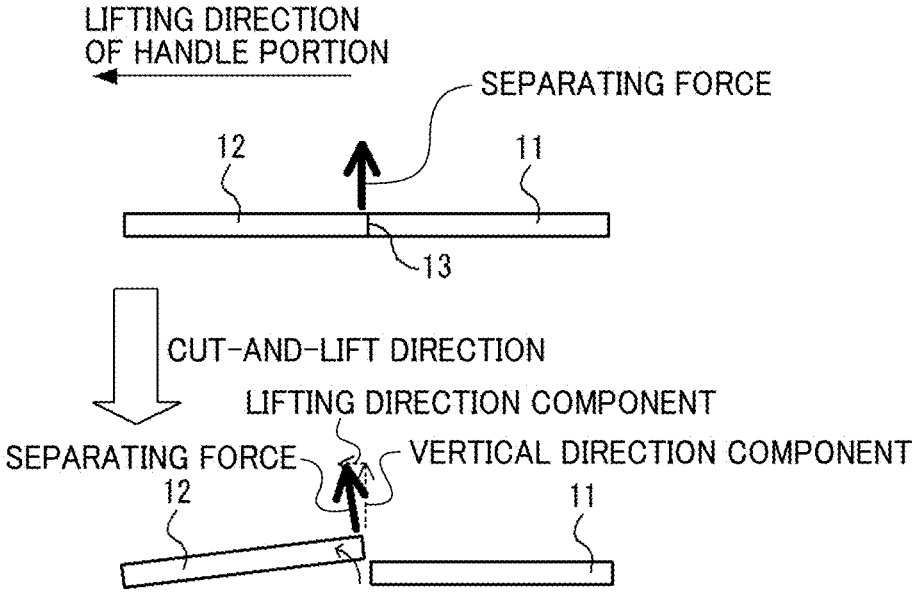
FIG. 5 is a schematic view illustrating a cutting and lifting operation of a handle portion of a package according to an embodiment of the present disclosure.

FIG. 5 is a schematic view illustrating a cutting and lifting operation of the handle portion 12. In FIG. 5, the upper surface 11 (base structure) of the inner box 10 provided with the handle portion 12 is illustrated in a state viewed from the thickness direction. In FIG. 5, a separating force (force to separate the handle portion 12 from the upper surface 11) at the beginning of lifting the handle portion 12 acts in a substantially upward direction (vertical direction). Interference occurs between the upper surface 11 and the handle portion 12 on both sides of the perforated lines 13 at the beginning of lifting the handle portion 12. However, providing the notched cut line 14 allows the handle portion 12 to separate from the upper surface 11 immediately after starting the cutting and lifting the handle portion 12. Thus, the resistance force due to the interference of the upper surface 11 can be removed. Similarly, the separating force acts in an oblique direction. For this reason, the separating force includes a vertical direction component and a lifting direction component, and separation of the handle portion 12 is facilitated by the lifting direction component. Accordingly, the handle portion 12 can be cut and lifted in a more labor-saving manner.

For the purpose of slightly lifting the handle portion 12 in the initial stage of cutting and lifting when the handle portion 12 (handle structure portion) as the separation-forming structure is separated and formed, the angle α of the notched cut line 14 is most effective when the angle α is parallel to the lifting direction kh. On the other hand, in a case in which the notched cut line 14 is provided so that the angle α is an acute angle (see part (b) of FIG. 4), desirably, the angle α is an acute angle as close to 0 degrees as possible because the length of the perforated line 13 divided in the lifting direction is an effective length among the lengths of the provided notched cut line 14.

In addition, it is necessary to provide the notched cut line 14 with a length as short as possible so as not to reduce the length of the existing connecting portion. An effective length of the notched cut line 14 may not be secured when the angle α is increased. As a verification, when the angle α of the notched cut line 14 of the 5 mm length is set to 45 degrees and the effect of lifting the handle portion 12 in the initial stage of lifting the handle portion 12 is hardly obtained. Specifically, when the angle α of the notched cut line 14 is set to equal to or greater than 45 degrees, a large force is required to separate the handle portion 12 and the separation-forming structure may be divided. On the other hand, in a case in which the angle α of the notched cut line 14 is an acute angle of 40 degrees or less, it is confirmed that the effect can be obtained. Thus, the range of the angle α is set to 40 degrees or less.

As described above with respect to the related art, the handle portion (handle structure portion) serving as the separation-forming structure originally has a role to be artificially separated and formed by an operator as needed. For this reason, when a box including a handle (handle structure portion) is assembled or when the box is transported as a packaged cargo, the handle portion (handle structure portion) needs to be prevented from being improperly separated and formed by a load caused by vibration and impact.

Figure 24:
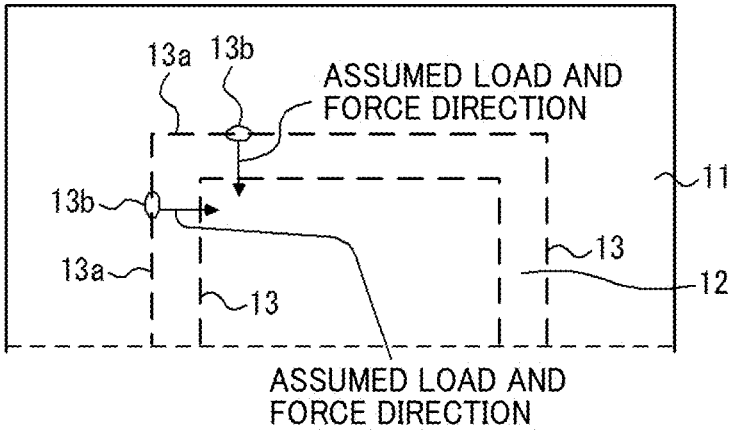
FIG. 24 is a schematic view of an upper surface of an inner box of a package illustrating directions of an assumed load and a force generated when a handle portion of a package is separated and formed according to an embodiment of the present disclosure.

For this reason, in the handle portion (handle structure portion), a plurality of connecting portions with the base structure are provided in advance in a wide range on the upper surface 11 and with a sufficient length to withstand tensile loads in multiple directions. FIG. 24 illustrates directions of loads and forces acting the connecting portion 13*b* of the perforated line 13, which are assumed when the handle portion 12 is separated and formed. The directions of assumed loads and forces may differ depending on the locations of the connecting portions 13*b*.

As described with reference to FIG. 23, in the related art, when the handle portion 12 is cut and lifted while cutting the handle portion 12, the handle portion 12 is rapidly cut at once as soon as the limit of the stress with respect to the cutting is reached, and the handle portion 12 is divided (defectively cut) in an action direction of the force. Thus, the function of the handle portion 12 may be impaired after the handle portion 12 is separated and formed.

For this reason, in the embodiment illustrated in FIG. 1, the notched cut line 14 includes a base portion 14*a* extending in the lifting direction kh for lifting the handle portion 12, and the leading end 14*c* deflected (changed in direction) at a bent point 14*b* and extending. The direction of the leading end 14*c* is set to be a direction toward a distal end 13*bt* of the connecting portion 13*b* or the vicinity of the distal end 13*bt*.

The base portion 14*a* and the leading end 14*c* of the notched cut line 14 in FIGS. 1, 2, and 3 are both provided as straight lines, and the direction of the leading end 14*c* is changed at the bent point 14*b*. However, the base portion 14*a* and the tip portion 14*c* may be connected by a curved line. As illustrated in FIG. 4, the notched cut line 14 may be provided as a curved line. In this case also, the distal end of the curved notched cut line 14 is provided in a direction toward the distal end 13*bt* of the connecting portion 13*b* or the vicinity of the distal end 13*bt*.

Figure 6:
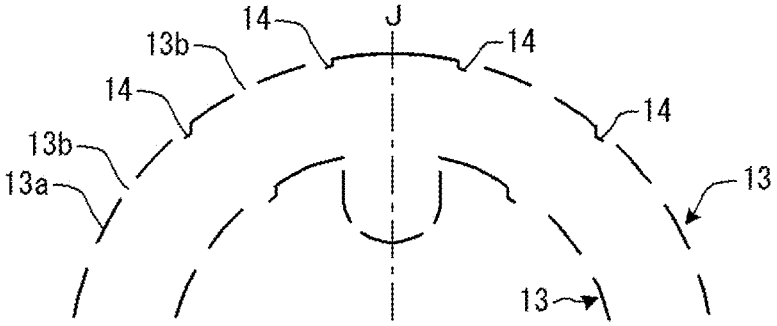
FIG. 6 is a schematic view illustrating an arrangement of notched cut lines provided on a package according to an embodiment of the present disclosure.

In any of the examples illustrated in FIGS. 1, 2, 3, and 4, when the perforated line 13 is doubly provided, the notched cut line 14 is provided on each of the double perforated lines 13. The position at which the notched cut line 14 is provided (the position at which the notched cut line 14 is provided on the connecting portion 13*b*) can be appropriately set. However, preferably, the notched cut line 14 is provided at a position relatively close to the center reference line J indicating the symmetrical axis (center) of the handle portion 12. As illustrated in FIG. 6, the notched cut lines 14 can be provided at the plurality of positions on the connecting portions 13*b*. FIG. 6 illustrates an example in which a plurality of notched cut lines 14 (two on one side of the central reference line J and four in total on both sides) are provided on the perforated line 13 having a larger radius than the other perforated line 13.

Figure 7:
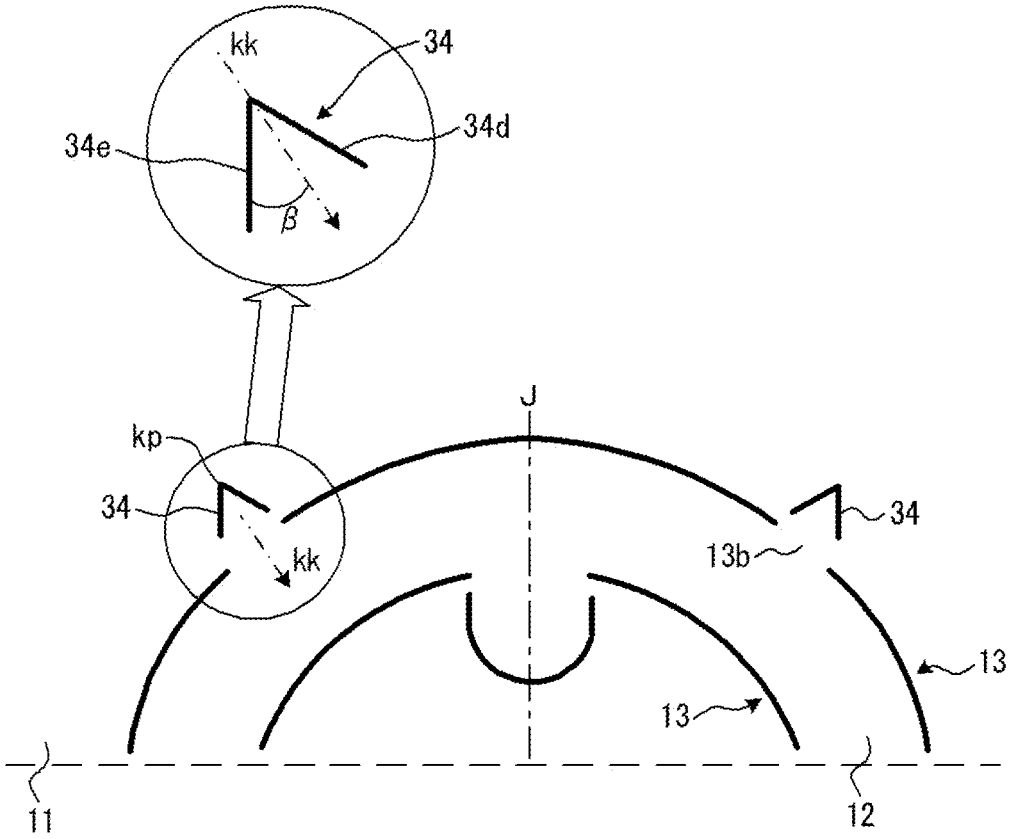
FIG. 7 is a schematic view illustrating notched cut lines provided on a package according to another embodiment of the present disclosure.

FIG. 7 illustrates another example of a notched cut line. Notched cut lines 34 illustrated in FIG. 7 do not start from a boundary point between the connecting portion 13*b* and the cut portion 13*a* in the perforated line 13. A starting point kp of each notched cut line 34 is set in the vicinity of the connecting portion 13*b*. At least two sides are provided with the notched cut line 34 such that distal ends of the notched cut line 34 extending from the starting point kp faces the handle portion 12 (handle structure portion) that is the separation forming structure. When a lifting direction of a portion cut and lifted by the notched cut line 34 is kk, a side 34*e* is provided on a leading end in the cut-and-lifted direction so that the angle β of the side 34*e* with respect to the lifting direction line kk is 0 (parallel to the lifting direction line kk) or an acute angle.

In the example illustrated in FIG. 7, the notched cut line 34 includes two sides 34*d* and 34*e* and has a dogleg shape. The starting point kp of the notched cut line 34 at which the sides 34*d* and 34*e* intersect is located in the vicinity of the connecting portion 13*b*. The angle β of the side 34*e* on the leading end in the cut-and-lifted direction with respect to the lifting direction line kk is set to be an acute angle.

In such a configuration, artificially pushing the range surrounded by the side 34*d* and side 34*e* of the notched cut line 34 cutting of the handle portion 12 to proceed to a rear side of FIG. 7 from the distal ends of the notched cut line 34 toward the handle portion 12 and the cut portion to merge with the perforated line 13. Thus, the separation-forming structure (handle portion 12) can be separated and formed in a labor-saving manner and improper cutting of the handle portion 12 can be prevented. The notched cut lines 34 may be provided at a plurality of positions of the connecting portions 13*b*.

Figure 8:
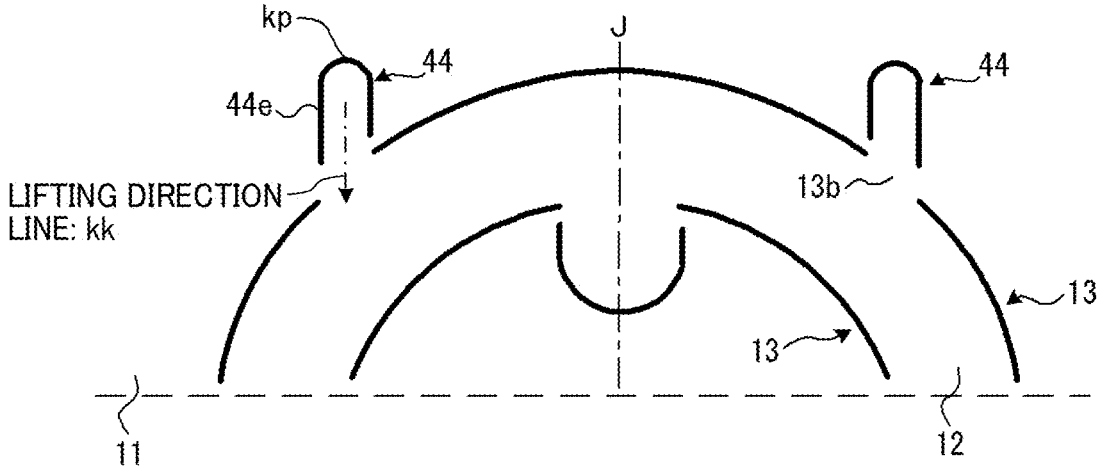
FIG. 8 is a schematic view illustrating notched cut lines provided on a package according to still another embodiment of the present disclosure.

FIG. 8 illustrates still another example of a notched cut line.

A notched cut line 44 of FIG. 8 differs from the notched cut line 34 of FIG. 7 in that the notched cut line 44 is "U" shaped rather than "V" shaped. The vertex of the "U" shape is a starting point kp. The starting point kp is located in the vicinity of the connecting portion 13*b*. In this example, a side 44*e* on the leading end in the cut-and-lifting direction is provided in parallel to the lifting direction line kk.

Note that, in the examples illustrated in FIGS. 7 and 8, the reason for setting the angle α of the side 44*e* on a leading end in the cut-and-lift direction to 0 (zero) to 40 degrees with respect to the lifting direction line ks is to remove the interference of the base structure (in this case, the upper surface 11) such that the separation-forming structure (handle portion 12) receives almost no resistance force as described above and to divide the force to cut and lift the separation-forming structure (handle portion 12) into the cutting direction. In addition, since the lifting direction line ks and the cutting direction naturally merge due to stress concentration, the angle α is set to zero to obtain an effect such that the cutting may progress with a small force.

Figure 9A:
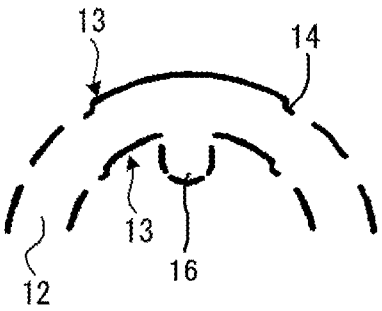
FIGS. 9A, 9B, and 9C are schematic views illustrating three examples of handle portions of a package in which each of the handle portions have a different shape according to an embodiment of the present disclosure.
Figure 9B:
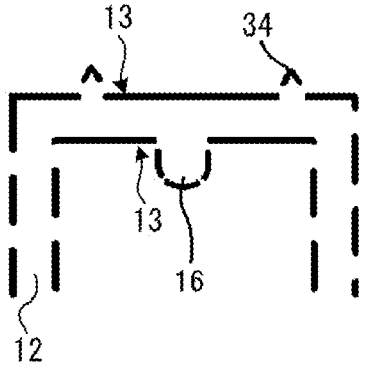
Figure 9C:
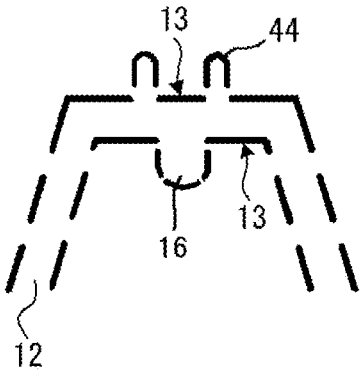

FIGS. 9A, 9B, and 9C are views of three examples in which the shapes of the handle portion 12 (handle structure portion) as the separation-forming structure are different. The semicircular handle portion 12 of FIG. 9A has been described above with reference to FIGS. 1 to 8 and the like and includes the notched cut lines 14. The handle portion 12 illustrated in FIG. 9B is an example of a handle portion having a quadrangular (square or rectangular) shape and includes the notched cut line 34 having a dogleg shape also illustrated in FIG. 7. The handle portion 12 of FIG. 9C is an example of a handle portion having a trapezoidal shape and includes a "U"-shaped notched cut line 44 also illustrated in FIG. 8. Providing the notched cut lines 14, 34, or 44 described above in the perforated lines 13 in the handle portion 12 having any shape allows the handle portion 12 to be easily cut and lifted with a small force. In addition, the handle portion 12 can be reliably lifted without being divided.

Figure 10:
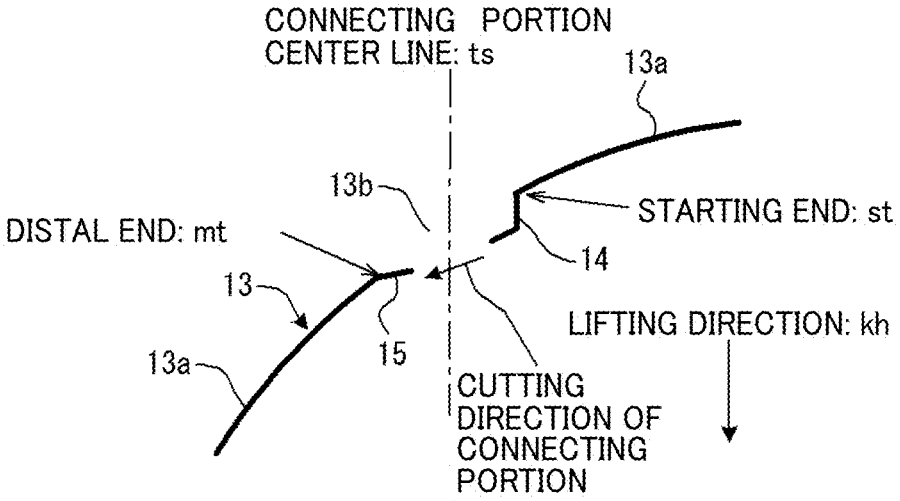
FIG. 10 is a partially enlarged view of a configuration example in which notched cut lines are also provided on ends of a connecting portion of a perforated line provided on a package according to an embodiment of the present disclosure.

FIG. 10 is a partially enlarged view illustrating a configuration example in which a notched cut line is also provided on a leading end of the connecting portion 13*b* of the perforated line 13, in other words, a leading end of the connecting portion 13*b* in the cutting direction. FIG. 10 is a partially enlarged view of one of the connecting portions 13*b* and the cut portions 13*a* on both sides of the one connecting portion 13*b* in the perforated line 13. The connecting portion 13*b* includes a notched cut line 14 at a starting end st (a starting point of cutting the connecting portion 13*b*). In addition to the notched cut line 14 on the trailing end of the connecting portion 13*b* in the cutting direction, a cut line 15 is also provided on the leading end mt (the leading end of the connecting portion 13*b* in the cutting direction).

The cut line (leading-end cut line) 15 is provided in a direction toward the terminal end of the notched cut line 14 on the trailing end (starting end) with the leading end of the connecting portion 13*b* as a starting point. The length of the cut line 15 on the trailing end falls within a range between the trailing end mt and the center of the connecting portion 13*b* (a range on the left side of center line is of the connecting portion 13*b* in FIG. 10).

As described above, providing the cut line 15 in the connecting portion 13*b* of the perforated line 13 at the trailing end of cut portions 13*a* in addition to the notched cut line 14 at the trailing end (starting end) of cut portions 13*a* cutting, which starts from the starting end st of the connecting portion 13*b*, to progress reliably to arrive at the leading end mt of the connecting portion 13*b*. Thus, collapse of the handle portion 12 (handle structure portion) that is the separation-forming structure can be restrained. In particular, such a configuration described above is effective in a case of using a material that is hard to cut and has high breaking strength.

Figure 11A:
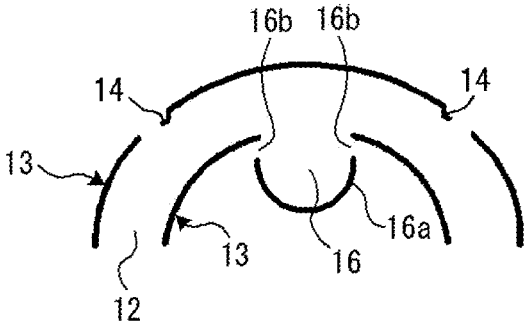
FIGS. 11A and 11B are schematic plan views of configuration examples of a handle portions of a package in which a pushed-in portion is provided in the vicinity of each of the handle portions of a package according to an embodiment of the present disclosure.
Figure 11B:
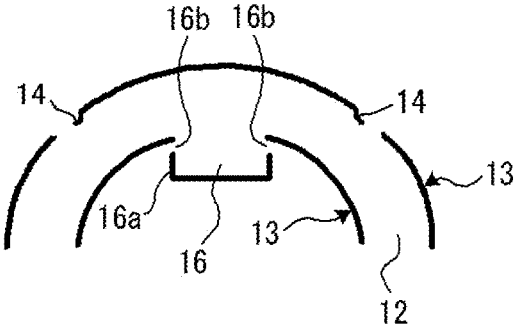

FIGS. 11A and 11B illustrate configuration examples in each of which a pushed-in portion is provided in the vicinity of the handle portion 12 (handle structure portion), which is a separation-forming structure, to facilitate cutting and lifting of the handle portion 12 by pushing the pushed-in portion at the start of the cutting and lifting. FIG. 11A illustrates a configuration in which a pushed-in portion 16 having a semicircular shape is provided. FIG. 11B illustrates a configuration in which a pushed-in portion 16 having a U-shape (or rectangular) is provided. The pushed-in portion 16 is pushed in to open a hole in which a finger is put in to cut and lift the handle portion 12. Thus, the separation-forming structure can be easily lifted. The pushed-in portion 16 includes a cut portion 16*a* and a connecting portion 16*b*. The pushed-in portion 16 is connected to an inside cut line via the connecting portion 16*b* to be provided in the vicinity of the handle portion 12.

Figure 12:
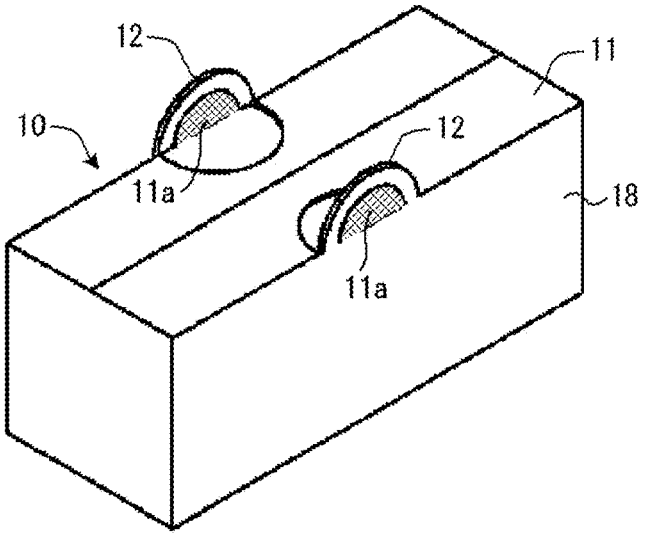
FIG. 12 is a perspective view of a package illustrating a possible disadvantage when cutting and lifting handle portions of a package according to an embodiment of the present disclosure.

Incidentally, when the handle portion 12 (handle structure portion) that is the separation-forming structure is cut and lifted, as illustrated in FIG. 12, a portion 11*a* of the upper surface 11 of the inner box 10, which is a portion (portion illustrated by cross-hatching in FIG. 12) not originally required to be lifted, may be lifted together with the handle portion 12. In this case, the semicircular or U-shaped hole portion (semicircular in FIG. 12) of the cut-and-lifted handle portion 12 for hooking a finger may be blocked by the portion 11*a* of the upper surface 11 of the inner box 10.

Figure 13A:
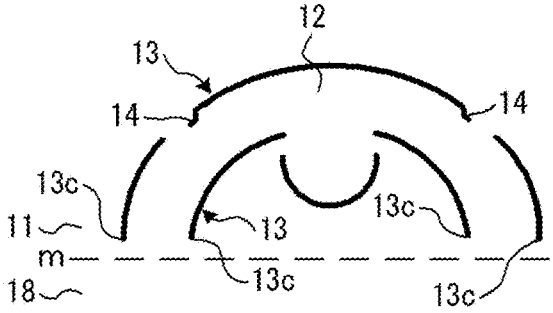
FIG. 13A is a schematic view illustrating a configuration of cutting lines whose ends are extended and connected to a structure of an inner box according to an embodiment of the present disclosure.
Figure 13B:
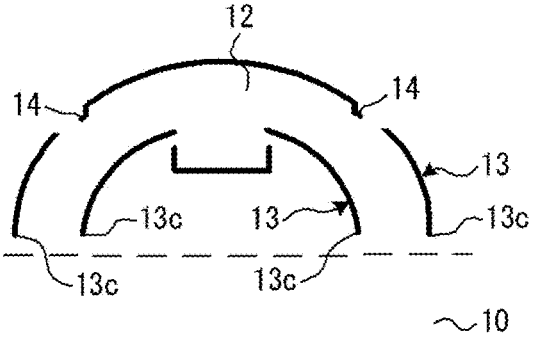
FIG. 13B is a schematic view illustrating a configuration of cutting lines whose ends are extended and connected to a structure of an inner box according to an embodiment of the present disclosure.
Figure 14:
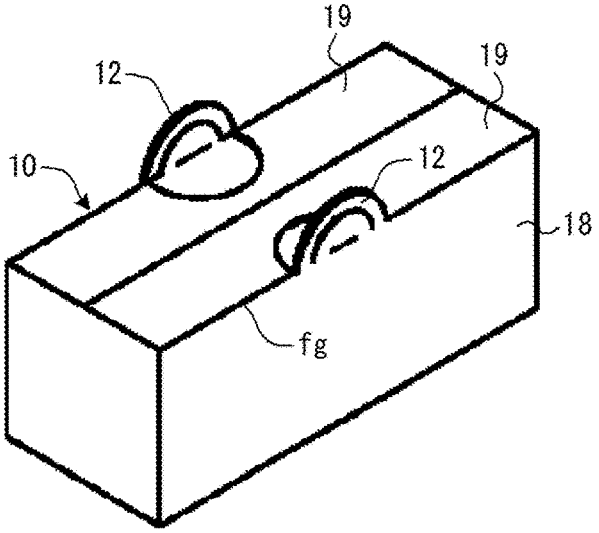
FIG. 14 is a perspective view of a package in which each one of handle portions is provided on outer longitudinal flap face of an inner box of a package according to an embodiment of the present disclosure.

For this reason, as illustrated in FIGS. 13A and 13B, distal ends 13*c* of the perforated lines 13 are provided away from a polygonal line m of the base structure of the inner box 10 so as not to intersect the polygonal line m (or a flap outline fg in FIG. 14). That is, the distal ends 13*c* of the perforated lines 13 constituting the outer shape of the handle portion 12 (handle structure portion) are provided apart from the boundary line (m or fg) between the upper surface 11 (surface on which the handle structure portion is arranged) and the adjacent surface 18 of the inner box 10 (box structure) so as not to intersect the boundary line (m or fg). Such an arrangement described above prevents the semicircular or U-shaped pushed-in hole (semicircular in FIG. 14) of the handle portion 12 for hooking a finger from lifting up together with the handle portion 12. Thus, the hole of the handle portion 12 can be prevented from being blocked.

Figure 15:
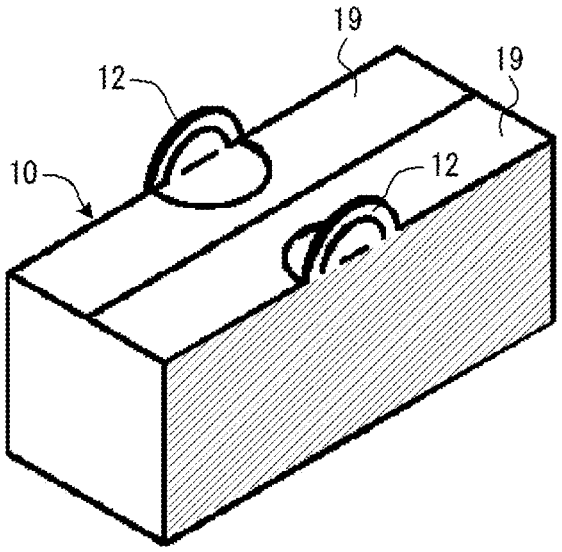
FIG. 15 is a perspective view of a package in which each one of handle portions is positioned in the vicinity of an upper end of a side wall of an inner box of a package according to an embodiment of the present disclosure.

As illustrated in FIG. 14, each of the handle portions 14 is provided on an outer longitudinal flap surface (surface to be opened and closed) 19 of the inner box 10. In this case, the flap surfaces 19 serve as the handle structure placement surfaces, and flap outlines fg serve as boundary lines with the adjacent surfaces 18. Thus, in a multi-layered package in which the inner box 10 is housed, the inner box 10 can be easily taken out from the outer box. Further, each of the handle portions 12 is provided so as to be positioned in the vicinity of the flap outline fg when cut and lifted. Thus, as illustrated in FIG. 15, each of the handle portions 12 is positioned in the vicinity of the upper end of the side wall of the inner box 10 (the hatched portion in FIG. 12), so that the point of action of the force to lift up the mass of a packaged object stored inside the inner box 10 is in the vicinity of the upper end of the side wall of the inner box 10. Accordingly, a force to open outer longitudinal flaps 19 does not work when the inner box 10 is lifted up, thereby restraining a force from being applied to adhesion tapes that fix the flaps. Thus, an unstable state in which the adhesion tapes may peel off and the inner box 10 may fall momentarily can be prevented.

Figure 16:
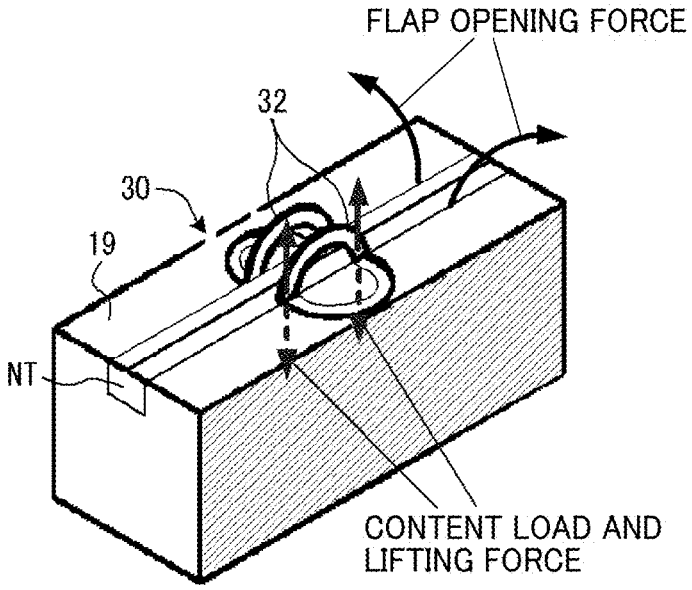
FIG. 16 is a perspective view of a package having a configuration example different from a configuration of a package according to an embodiment of the present disclosure.

FIG. 16 illustrates a configuration example that differs from an embodiment of the present disclosure and is an example in which handle portions 32 are disposed in the vicinity of the center of an upper surface of an inner box 30. In this case, the content load and the force to lift up the handles 32 are applied to the vicinity of the center of the upper surface of the inner box 30. Accordingly, the flap opening force to open the flaps is generated, and the force is applied to an adhesive tape NT for fixing flaps 19 and the adhesive tape NT might be peeled off.

Note that, in the present embodiment, a double-faced cardboard or a multi double-faced cardboard can be used for the inner box 10. When a heavy article to be packaged is put in the inner box 10, preferably, the multi double-faced corrugated cardboard is used.

Figure 17:
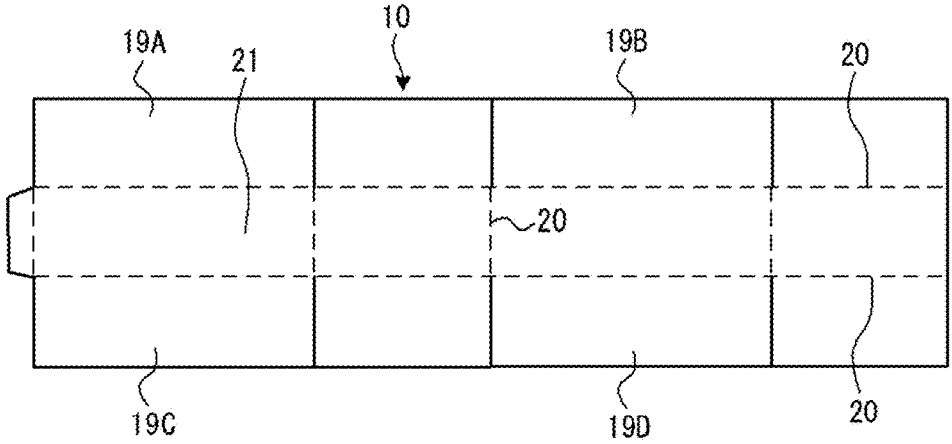
FIG. 17 is a developed view of a corrugated cardboard sheet constituting an inner box of a package as an example according to an embodiment of the present disclosure.

FIG. 17 is a developed view of an example of a corrugated cardboard sheet constituting the inner box 10. The inner box 10 illustrated in FIG. 17 includes four flaps 19A, 19B, 19C, and 19D arranged on both sides of the inner box 10 and includes a body frame 21 that contacts the flaps 19A, 19B, 19C, and 19D via folding lines 20. Among the four flaps 19A, 19B, 19C, and 19D, the flaps 19A and 19B on an upper side in FIG. 17 are top flaps, and the flaps 19C and 19D on a lower side in FIG. 17 are bottom flaps. The handle portions 12, which are separation-forming structures, are provided on the top flaps 19A and 19B.

Figure 18:
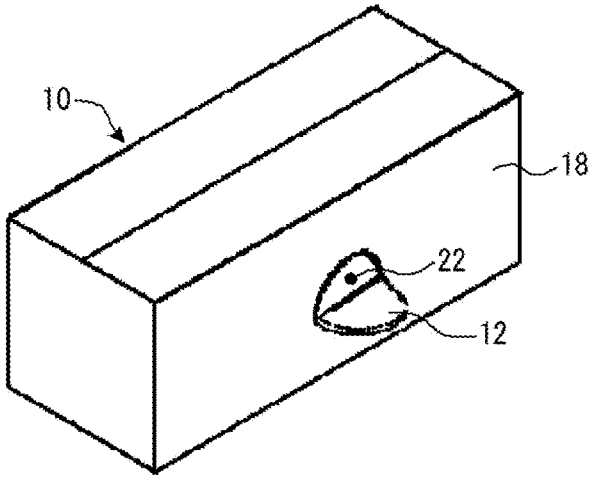
FIG. 18 is a perspective view of a package having a configuration example in which each one of handle portions is disposed on a side face of an inner box of a package according to an embodiment of the present disclosure.

FIG. 18 illustrates an example of a configuration in which the handle portions 12 as the separation-forming structure are disposed on side faces 18 of the inner box 10. One of the handle portions 12 is also provided on an opposite side face of the inner box 10. In this configuration example, an additional article can be put into the inner box 10 by using holes 22 formed by cutting and lifting the handle portions 12 provided on the side faces of the inner box 10.

Finally, a description is given of experiments to verify the force at the time of cutting and lifting the handle portions 12, which are the separation-forming structure, using a configuration in which the notched cut lines 14 as a feature configuration according to an embodiment of the present disclosure are provided and another configuration in which the notched cut lines 14 are not provided.

Experiment 1

Figure 19A:
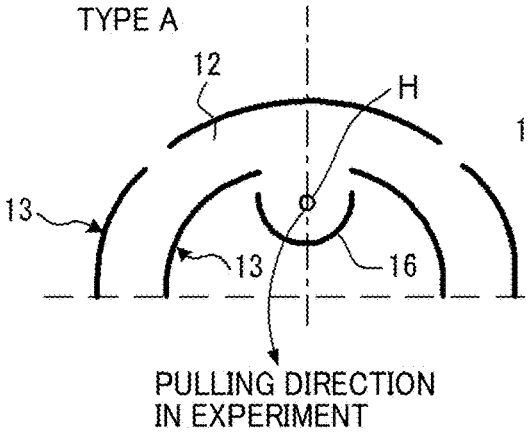
FIGS. 19A and 19B are plan views of handle portions having configurations used in verification experiments according to an embodiment of the present disclosure.
Figure 19B:
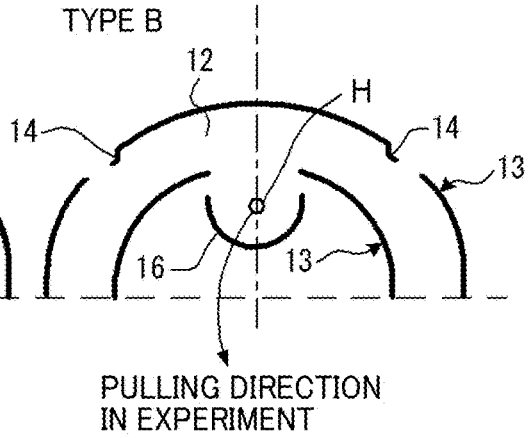
Figure 20:
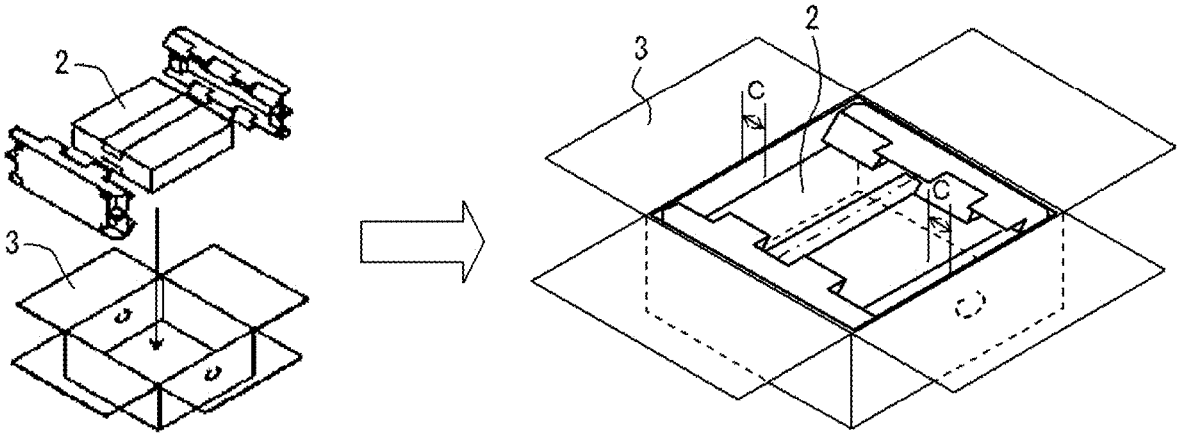
FIG. 20 is a perspective view of a package having a multi-layered package specification according to an embodiment of the present disclosure.
Figure 21:
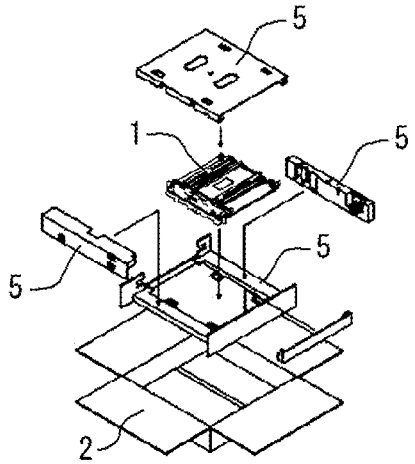
FIG. 21 is a perspective view of a package having a configuration in which the rigidity of a product is supported by a rigidity supporting material and an inner box according to an embodiment of the present disclosure.
Figure 22:
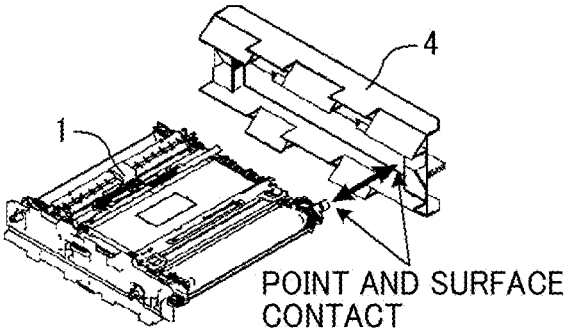
FIG. 22 is a perspective view of a portion of a package ang a product to be packaged in which an outer shape of the product and a packaging material of the package locally contact each other according to an embodiment of the present disclosure.

FIG. 19A illustrates a package in which the notched cut lines 14 according to the present embodiment are not provided. FIG. 19B illustrates a package in which the notched cut lines 14 are provided according to the present embodiment. In either configuration, a hole H was provided at a center of the pushed-in portion 16 of the separation-forming structure for cutting and lifting the handle portion 12, and the pull-in force required for cutting and lifting the handle portion 12 was measured using a push-pull gauge with the hole H as a starting point. The lifting direction in the verification experiments is the direction indicated by the arrows in FIGS. 19A and 19B. The maximum pull-out force and the average value of the pull-out force in three experiments are represented in the following Table 1.

TABLE 1

| Experiment No. | Type A configuration: Maximum pull and opening force without notched cut line (gf) | Type B configuration: Maximum pull and opening force with notched cut line (gf) |
|---|---|---|
| N1 | 8,050.0 | 2,020.0 |
| N2 | 8,200.0 | 1,940.0 |
| N3 | 8,150.0 | 2,260.0 |
| Average | 8,133.3 | 2,073.3 |

In Type-A configuration, i.e., a configuration in which the notched cut lines 14 are not provided, the average value of the pull-out force is 8133.3 gf, whereas in the configuration in which the notched cut lines 14 are provided, the average value of the pull-out force is 2073.3 gf. Thus, it was demonstrated that the configuration according the embodiment including the notched cut line 14 can cut and lift the handle portion 12 with a smaller force.

Note that the sheet-shaped forming member as a material constituting the package is not limited to the corrugated board sheet, and any forming member can be used. Under the present circumstances, the corrugated board sheet is excellent in many points such as impact buffering property, environmental performance, weight, price, availability, resource recovery property and recycling property. The corrugated board sheet is also used as a material in the above-described embodiments of the present disclosure. If advantageous materials are developed and realized in the future, embodiments of the present disclosure can be implemented by using such materials.

In the packaging body according to the above-described embodiments of the present disclosure, the handle structure portion can be lifted almost without receiving resistance force in the initial stage of lifting the handle structure portion. Accordingly, the resistance force due to interference of the structure can be removed and the connecting portion can be easily cut. Thus, the handle structure portion can be cut and lifted in a more labor-saving manner. Further, the handle structure portion can be reliably lifted without being divided.

The notched cut line includes a bent straight line or a curved line in which the reference direction line connecting the middle point of the notched cut line and the boundary point that is the start point of the cut line is parallel to or forms an acute angle with the lifting direction of the handle structure portion. Thus, the handle structure portion can be cut and lifted in a labor-saving manner even when the notched cut line having a curved-line shape is employed. The handle structure portion can also be reliably lifted without being divided.

The notched cut line is provided so as to have at least two sides whose leading ends face the handle structure portion with the vicinity of the connecting portion as a starting point, and the angle β between the side on the leading end in the cut-and-lifted direction and the lifting direction of the portion cut and lifted by the notched cut line is parallel or an acute angle. Thus, the cut-and-lift operation of the handle structure portion can be performed in a labor-saving manner.

When the acute angle is in the range of 1 to 40 degrees, the same effect as in the case in which the angle is parallel to the lifting direction can be obtained.

The outer shape of the handle structure portion is semicircular or U-shaped. Thus, the handle structure portion can be cut and lifted smoothly.

The outer shape of the handle structure portion is a U-shape or a trapezoidal shape. Accordingly, the handle structure portion having various shapes can be formed. Even in such a case, cutting and lifting operation can be performed easily.

The notched cut line having a dogleg shape or a U shape can prevent defective cutting.

Providing two or more notched cut lines in the perforated cut line can achieve reliable cutting.

The notched cut line (leading-end notched cut line) directed toward the other notched cut line is provided at the leading end of the connecting portion on which the notched cut line is provided, and the leading-end notched cut line is provided so as to be included in the range between the leading end and the center of the connecting portion. Thus, the notched cut lines at the both ends allow cutting and lifting to be more reliably and easily performed.

The pushed-in portion including the cut portion and the connecting portion is provided in the vicinity of the handle structure portion. Accordingly, a hole can be opened by pushing in the pushed-in portion and a lifting operation of the handle structure portion by engaging a finger on the hole can be performed. Therefore, the handle structure portion can be more easily lifted.

Since the pushed-in portion is connected to the cut line via the connecting portion, cutting from the pushed-in portion to the cut line can be continued, and the handle structure portion can be lifted more reliably and easily.

The outer shape of the pushed-in portion is a semicircular shape, a U-shape, or a quadrangular shape. Thus, an easy cutting and lifting operation with the pushed-in portion having various shapes can be performed.

Further, the handle structure portion is provided on the outer longitudinal flap surface of the inner box of the multi-layered packaging to house the object to be packaged. Accordingly, the handle structure portion to easily take out the inner box from the outer packaging box can be formed in the multi-layered packaging including a plurality of box bodies.

The distal ends of the cut lines constituting the outer shape of the handle structure portion are provided away from the boundary line between the surface on which the handle structure portion is arranged and an adjacent surface of the handle structure portion so as not to intersect with the boundary line. Thus, a portion that does not originally need to be lifted together with the handle structure portion can be prevented from being lifted. Accordingly, the opening portion of the handle structure portion can be prevented from being closed.

The handle structure portion is located in the vicinity of the flap outline on the flap surface when the handle structure portion is lifted. Thus, the handle structure portion can be formed to be located in the vicinity of an upper portion of a side wall of the inner box. Accordingly, an action point of the force to lift up the mass of packaged objects is positioned in the vicinity of the side wall of the inner box. For this reason, a force to open the outer longitudinal flap does not work when the inner box is lifted and a force is unlikely to be applied to the adhesive tape for fixing the outer longitudinal flap. Thus, the interior box can be prevented from instantaneously falling into an unstable state due to the peeling off of the adhesive tape.

The handle structure portion is provided on the surface of the box structure configured as the box body. Accordingly, the additional packaged objects can be included into the package by using, for example, a hole formed by cutting and lifting a handle portion provided on a side face of the inner box.

The box structure is formed of the sheet-shaped forming member. Thus, the package can be formed at low cost.

The sheet-shaped forming member is made of corrugated cardboard. Thus, cost reduction can be achieved, and environmental performance, weight, price, availability, resource recoverability, recyclability, and the like can be achieved at a high level with good balance.

The corrugated cardboard is a double-faced corrugated cardboard or a double-faced corrugated cardboard. Thus, various performance requirements can be met. In a case in which the mass of the packaged object is large and the package also requires a suitable rigidity, the double-faced corrugated board can be applied.

In a case in which an image forming device for an image forming apparatus or the image forming apparatus is packaged as a packaged object, an inner box in which the packaged object having a large weight is stored can be safely taken out by using the reliably lifted handle structure portion. Accordingly, failure or damage of the image forming device or the image forming apparatus can be prevented.

Although some embodiments of the present disclosure have been described based on the illustrated examples, embodiments of the present disclosure are not limited to the above-described embodiments. The shape and size of the package, and the size, shape, position and the like of the handle structure portion can also be appropriately set.

The image forming device of the image forming apparatus as the packaged item is not limited to a main unit of the image forming device, and may be any of various built-in units of the image forming device. The image forming apparatus is not limited to a printer, and may be a copying machine, a facsimile machine, or a multifunction peripheral having a plurality of functions.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present disclosure.

What is claimed is:

1. A package comprising:

a structure configured to constitute a housing space to house a packaged object; and a handle structure portion disposed in the structure and configured to be formed by a perforated line and to be lifted from the structure, the perforated line forming an external shape of the handle structure portion, the perforated line including;

a cut portion;

a connecting portion; and a plurality of notched cut lines starting from a boundary point between a cutting termination point of the cut portion and a cutting start point of the connecting portion, wherein the plurality of notched cut lines is provided symmetrically with respect to a central reference line that is an axis of symmetry of the handle structure portion, wherein the connecting portion is between the cut portion and another cut portion, the cut portion being closer to the central reference line than the another cut portion, wherein each of the plurality of notched cut lines includes:

a base portion extending from the boundary point in parallel to or at an acute angle with respect to a lifting direction of the handle structure portion; and a leading end portion turned from the base portion toward a distal end portion of the connecting portion of the connecting portion, and wherein each of the plurality of notched cut lines is included within a range closer to the boundary point than a center line of the connecting portion parallel to the lifting direction of the handle structure portion, the center line of the connecting portion being within the connecting portion.

2. The package according to claim 1, wherein the notched cut line is formed of a straight bent line or a curved line, wherein a reference direction line of the curved line connecting a midpoint of the notched cut line and the boundary point is parallel to or forms an acute angle with the lifting direction of the handle structure portion, the boundary point being a start point of the notched cut line.

3. The package according to claim 1, wherein the acute angle is in a range of 1 to 40 degrees.

4. The package according to claim 1, wherein an outer shape of the handle structure portion is a semicircular shape or a U-shape.

5. The package according to claim 1, wherein an outer shape of the handle structure portion is a U-shape or a trapezoidal shape.

6. The package according to claim 1, wherein the notched cut line is provided at a trailing end of the connecting portion in a cutting direction of the connecting portion, the perforated line includes a distal-end notched cut line at the distal end of the connecting portion in the cutting direction, the distal-end notched cut line is directed toward the notched cut line, and wherein the distal-end notched cut line is included in a range between the distal end and the center line of the connecting portion.

7. The package according to claim 1, wherein a pushed-in portion including the cut portion and the connecting portion is provided along the handle structure portion.

8. The package according to claim 7, wherein the pushed-in portion is connected to the perforated line via the connecting portion.

9. The package according to claim 7, wherein an outer shape of the pushed-in portion is a semicircular shape, a U-shape, or a quadrangular shape.

10. The package according to claim 1, wherein the handle structure portion is provided on an outer longitudinal flap surface of an inner box of multi-layered package that houses a packaged object.

11. The package according to claim 10, wherein the handle structure portion is configured to be positioned along an outline of the outer longitudinal flap surface of the inner box when the handle structure portion is cut and lifted.

12. The package according to claim 1, wherein a distal end of the perforated line constituting the outer shape of the handle structure portion is provided away from a boundary line between an arrangement surface of the handle structure portion and an adjacent surface of the structure so as not to intersect with the boundary line.

13. The package according to claim 1, wherein the handle structure portion is provided on a surface of the structure configured as a box body.

14. The package according to claim 1, wherein the structure is formed of a sheet-shaped forming member.

15. The package according to claim 14, wherein the sheet-shaped forming member is a corrugated cardboard.

16. The package according to claim 1, wherein the package is configured to house an image forming device of an image forming apparatus or an image forming apparatus as a packaged object.

17. The package according to claim 1, wherein the notched cut line is between the cut portion and the another cut portion.

18. A package comprising:

a structure configured to constitute a housing space to house a packaged object; and a handle structure portion configured to be formed by a perforated line and to be lifted from the structure, the perforated line forming an external shape of the handle structure portion, the perforated line including:

a cut portion;

a connecting portion, the connecting portion being between the cut portion and another cut portion, the cut portion being closer to a central reference line that is an axis of symmetry of the handle structure portion than the another cut portion, a center line of the connecting portion parallel to the lifting direction of the handle structure portion being within the connecting portion; and a notched cut line having a start point in at one end of the connecting portion, wherein the notched cut line includes at least two sides extending from the start point, each of the at least two sides having a distal end opposite the handle structure portion.

19. The package according to claim 18, wherein an angle between one side of the at least two sides on a leading end in a cut-and-lift direction and a lifting direction of a portion cut and lifted along the notched cut line is zero or an acute angle.

20. The package according to claim 18, wherein the notched cut line is dogleg-shaped or U-shaped.

* * * * *